US005876888A

United States Patent [19]

Anayama et al.

[11] Patent Number: 5,876,888

[45] Date of Patent: Mar. 2, 1999

[54] ELECTROPHOTOGRAPHIC PHOTOSENSITIVE MEMBER, AND APPARATUS AND PROCESS CARTRIDGE PROVIDED WITH THE SAME

[75] Inventors: Hideki Anayama, Susono; Akira Yoshida, Shizuoka-ken, both of Japan

[73] Assignee: Canon Kabushiki Kaisha, Tokyo, Japan

[21] Appl. No.: 887,425

[22] Filed: Jul. 2, 1997

[30] Foreign Application Priority Data

Jul. 4, 1996 [JP] Japan ..... 8-175132
Jul. 4, 1996 [JP] Japan ..... 8-175136

[51] Int. Cl.[6] ..... G03G 5/05

[52] U.S. Cl. ..... 430/58; 430/96

[58] Field of Search ..... 430/58, 59, 66, 430/96; 349/297, 149

[56] References Cited

U.S. PATENT DOCUMENTS

| | | | |
|---|---|---|---|
| 3,837,851 | 9/1974 | Shattuck et al. | 96/1.5 |
| 3,871,880 | 3/1975 | Montillier | 96/1.5 |
| 3,935,154 | 1/1976 | Cawley | 260/33.8 |
| 5,254,423 | 10/1993 | Mayama et al. | 430/58 |
| 5,418,099 | 5/1995 | Mayama et al. | 430/58 |
| 5,492,786 | 2/1996 | Sugimura et al. | 430/96 |
| 5,693,443 | 12/1997 | Nakamura et al. | 430/66 |

FOREIGN PATENT DOCUMENTS

| | | |
|---|---|---|
| 0403662 | 12/1990 | European Pat. Off. . |
| 0538070 | 4/1993 | European Pat. Off. . |
| 0552740 | 7/1993 | European Pat. Off. . |
| 56-167759 | 12/1981 | Japan . |
| 57-17826 | 1/1982 | Japan . |
| 57-19576 | 2/1982 | Japan . |
| 58-40566 | 3/1983 | Japan . |
| 61-228453 | 10/1986 | Japan . |
| 61-272754 | 12/1986 | Japan . |
| 63-149668 | 6/1988 | Japan . |

*Primary Examiner*—John Goodrow
*Attorney, Agent, or Firm*—Fitzpatrick, Cella, Harper & Scinto

[57] ABSTRACT

A surface layer of a photosensitive layer contains at least one resin selected from the group consisting of (a) a polyarylate resin having a structural unit represented by the following general formula (1) and (b) a polycarbonate resin having a structural unit represented by the following general formula (2):

(1)

wherein, $X_1$ and $X_2$ are each single bond, —O—, —S— or substituted or unsubstituted alkylene and are the same or different, $R_1$ to $R_8$ and $R_{11}$ to $R_{14}$ are each hydrogen, halogen, or substituted or unsubstituted alkyl or aryl and are the same or different, and $R_9$ and $R_{10}$ are each hydrogen, halogen, or substituted or unsubstituted silyl, alkyl or aryl and are the same or different, and n is an integer of 2 or more;

(2)

wherein $X_3$ and $X_4$ are each single bond, —O—, —S— or substituted or unsubstituted alkylene and are the same or different, $R_{15}$ to $R_{22}$ are each hydrogen, halogen, substituted or unsubstituted alkyl or aryl and are the same or different, $R_{23}$ and $R_{24}$ are each hydrogen, halogen, substituted or unsubstituted silyl, alkyl or aryl and are the same or different, and m is an integer of 2 or more.

21 Claims, 1 Drawing Sheet

ELECTROPHOTOGRAPHIC PHOTOSENSITIVE MEMBER, AND APPARATUS AND PROCESS CARTRIDGE PROVIDED WITH THE SAME

BACKGROUND OF THE INVENTION

Field of the Invention

The present invention relates to electrophotographic photosensitive members, process cartridges and electrophotographic apparatuses. In particular, the present invention relates to an electrophotographic photosensitive member, a process cartridge and electrophotographic apparatus provided with a photosensitive layer containing a specified resin.

Description of the Related Art

Recently, various electrophotographic photosensitive members containing organic photoconductive materials have been subjected to intensive development. For example, U.S. Pat. No. 3,837,851 discloses a photosensitive member having a charge transfer layer containing triallylpyrazoline, and U.S. Pat. No. 3,871,880 discloses a photosensitive member comprising a charge generating layer containing a perylene pigment derivative and a charge transfer layer containing a condensation product of 3-propylene and formaldehyde.

Organic photoconductive materials are sensitive to their characteristic wavelength ranges. For example, Japanese Unexamined Patent Publication Nos. 61-272754 and 56-167759 disclose compounds highly sensitive to visible light, and Japanese Unexamined Patent Publication Nos. 57-19576 and 61-228453 disclose compounds highly sensitive to an infrared region. Among them, compounds highly sensitive to an infrared region have been increasingly used in laser beam printers (hereinafter referred to as LBP) and LED printers.

Meanwhile, electrophotographic photosensitive members must be provided with sensitivity, electrical characteristics, mechanical properties and optical characteristics suitable for the electrophotographic processes employed. In particular, electrophotographic photosensitive members must be durable against repeated electrical and mechanical forces, such as charging, exposure, development, transfer and cleaning, directly applied to their surfaces. In particular, they must have high electric and mechanical resistance to deterioration due to ozone and nitrogen oxides forming during charging, and surface abrasion occurring during discharging and cleaning.

Another problem to be solved is a phenomenon called "photomemory" in which a residual carrier on the light irradiated section forms a potential difference with the non-light irradiated section.

Contact charging processes, in which a charging member comes in contact with an electrophotographic photosensitive member and the electrophotographic photosensitive member is charged by applying a voltage to the charging member, have been increasingly employed, as disclosed in Japanese Unexamined Patent Publication Nos. 57-17826 and 58-40566, and cause new problems. Contact charging processes have some technical and economical advantages as compared to scorotrons; for example, extremely low ozone formation, and low electricity consumption (in scorotrons, approximately 80% of current applied to a wire of the charger flows to a shield of the charger).

However, contact of the charging member with an electrophotographic photosensitive member requires a higher mechanical strength for the electrophotographic photosensitive member. Further, use of an input voltage, in which an AC voltage is superposed on a DC voltage, is proposed in order to improve charging stability of the contact charging processes due to electric discharge (Japanese Unexamined Patent Publication No. 63-149668).

Superposition of an AC voltage drastically increases the current flow in the electrophotographic photosensitive member concurrently with improvement in charging stability, and thus causes increased damage or abrasion of the electrophotographic photosensitive member. Therefore, electrical durability, as well as mechanical strength, are required for electrophotographic photosensitive members.

Also, high resistance to solvent cracks formed by adhesion of mechanical oil and finger grease are essential for electrophotographic photosensitive members.

SUMMARY OF THE INVENTION

It is an object of the present invention to provide an electrophotographic photosensitive member having excellent electrical and mechanical durability, and high solvent crack resistance.

It is another object of the present invention to provide a process cartridge and electrophotographic apparatus provided with the electrophotographic photosensitive member set forth above.

The electrophotographic photosensitive member in accordance with the present invention comprises a substrate and a photosensitive layer formed thereon, a surface layer of the photosensitive layer containing at least one resin selected from the group consisting of (a) a polyarylate resin having a structural unit represented by the following general formula (1) and (b) a polycarbonate resin having a structural unit represented by the following general formula (2):

(1)

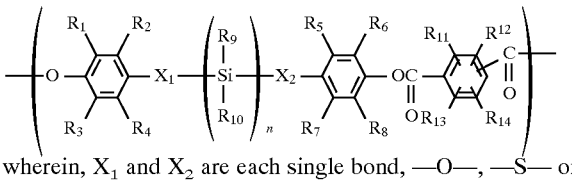

wherein, $X_1$ and $X_2$ are each single bond, —O—, —S— or substituted or unsubstituted alkylene and are the same or different, $R_1$ to $R_8$ and $R_{11}$ to $R_{14}$ are each hydrogen, halogen, or substituted or unsubstituted alkyl or substituted or unsubstituted aryl and are the same or different, and $R_9$ and $R_{10}$ are each hydrogen, halogen, or substituted or unsubstituted silyl, substituted or unsubstituted alkyl or substituted or unsubstituted aryl and are the same or different, and n is an integer of 2 or more;

(2)

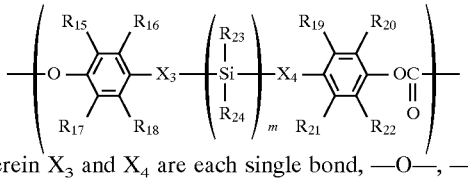

wherein $X_3$ and $X_4$ are each single bond, —O—, —S— or substituted or unsubstituted alkylene and are the same or different, $R_{15}$ to $R_{22}$ are each hydrogen, halogen, substituted or unsubstituted alkyl or substituted or unsubstituted aryl and are the same or different, $R_{23}$ and $R_{24}$ are each hydrogen, halogen, substituted or unsubstituted silyl, substituted or unsubstituted alkyl or substituted or unsubstituted aryl and are the same or different, and m is an integer of 2 or more.

In accordance with other aspects of the present invention, a process cartridge and an electrophotographic photosensitive member include the electrophotographic apparatus set forth above.

DETAILED DESCRIPTION OF THE PREFERRED EMBODIMENTS

Figure 1:
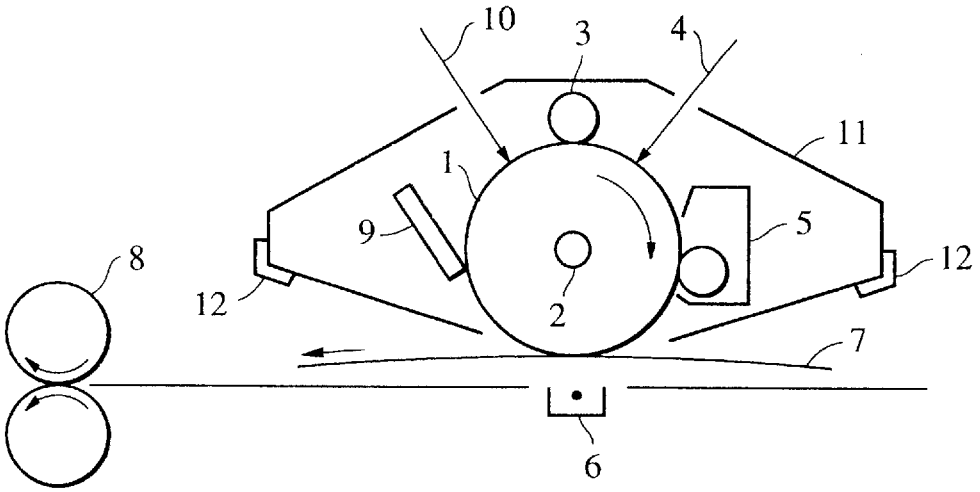
FIG. 1 is a schematic cross-sectional view illustrating an example of an electrophotographic apparatus provided with a process cartridge using an electrophotographic photosensitive member in accordance with the present invention.

The electrophotographic photosensitive member in accordance with the present invention comprises a substrate and a photosensitive layer formed thereon. As employed herein, the phrase "a surface layer" encompasses the photosensitive layer by itself, where the photosensitive layer is a single layer and also includes the outer layer of the photosensitive layer, when the photosensitive layer is a structure formed by laminating together a plurality of layers. A surface layer of the photosensitive layer contains at least one resin selected from the group consisting of (a) a polyarylate resin having a structural unit represented by the following general formula (1) and (b) a polycarbonate resin having a structural unit represented by the following general formula (2):

(1)

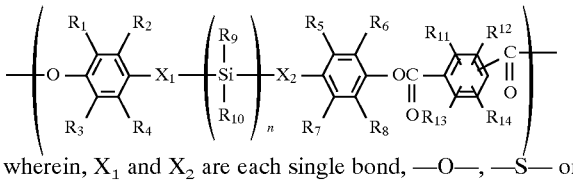

wherein, $X_1$ and $X_2$ are each single bond, —O—, —S— or substituted or unsubstituted alkylene and are the same or different, $R_1$ to $R_8$ and $R_{11}$ to $R_{14}$ are each hydrogen, halogen, or substituted or unsubstituted alkyl or substituted or unsubstituted aryl and are the same or different, and $R_9$ and $R_{10}$ are each hydrogen, halogen, or substituted or unsubstituted silyl, substituted or unsubstituted alkyl or substituted or unsubstituted aryl and are the same or different, and n is an integer of 2 or more;

(2)

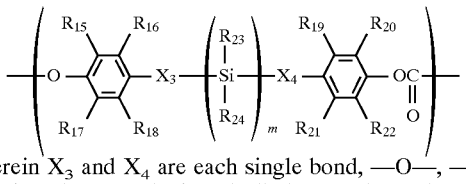

wherein $X_3$ and $X_4$ are each single bond, —O—, —S— or substituted or unsubstituted alkylene and are the same or different, $R_{15}$ to $R_{22}$ are each hydrogen, halogen, substituted or unsubstituted alkyl or substituted or unsubstituted aryl and are the same or different, $R_{23}$ and $R_{24}$ are each hydrogen, halogen, substituted or unsubstituted silyl, substituted or unsubstituted alkyl or substituted or unsubstituted aryl and are the same or different, and m is an integer of 2 or more. Both m and n are positive integers.

The alkylene groups in the general formulae (1) and (2) are preferably methylene, ethylene, and i-propylene. The halogen atoms include fluorine, chlorine, and bromine. The alkyl groups are preferably lower alkyl and cycloalkyl, such as methyl, ethyl, propyl, and cyclohexyl. The aryl groups are preferably phenyl, naphthyl and anthryl.

The substituents for the groups set forth above include halogen, such as fluorine, chlorine and bromine; alkyl, such as methyl, ethyl and propyl; aryl, such as phenyl, naphthyl and anthryl; aralkyl, such as benzyl and phenethyl; and alkoxy, such as methoxy, ethoxy and propoxy. The single bond in $X_1$ to $X_4$ means a direct bond between the benzene ring and the silicon atom, as exemplified in Compounds 10 and 11 represented below.

$R_9$, $R_{10}$, $R_{23}$ and $R_{24}$ may be present in combinations of two or more types in the molecule. In other words, two or more types of 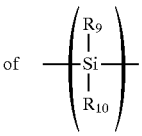 and 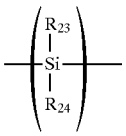

may be present in the molecule.

Suffixes n and m in the general formulae (1) and (2) are each an integer of 2 or more. These suffixes are preferably 50 or less in view of satisfactory flexibility, and more preferably 20 or less.

The weight average molecular weight of the polyarylate resin used in the present invention preferably ranges from 50,000 to 300,000, and more preferably from 60,000 to 150,000. The weight average molecular weight of the polycarbonate resin used in the present invention preferably ranges from 30,000 to 300,000, and more preferably from 40,000 to 80,000. The weight average molecular weight is derived by gel permeation chromatography.

The polyarylate resin having a structural unit represented by the general formula (1) can be prepared by interfacial polymerization of bisphenol represented by the following general formula (3) in the presence of a chloride of an aromatic dicarboxylic acid and an alkali in a nonaqueous solvent/water system:

(3)

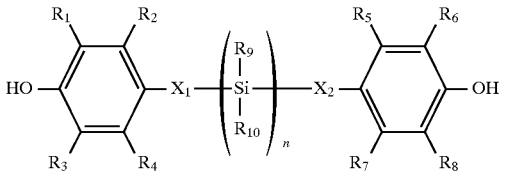

wherein $X_1$, $X_2$, $R_1$ to $R_{10}$ and n are the same as in the formula (1).

The aromatic dicarboxylic acid preferably has the following general formula (4):

(4)

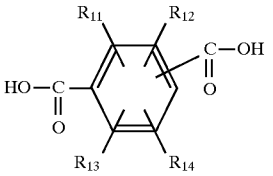

wherein $R_{11}$ and $R_{14}$ are the same as in the general formula (1).

Two or more kinds of chlorides of aromatic dicarboxylic acids represented by the general formula (4), for example, terephthaloyl chloride and isophthaloyl chloride, are preferably used in order to enhance solubility of the resulting resin.

The ratio of one chloride to the other chloride in the mixture is determined in view of solubility of the resulting resin, and preferably is 1/1 in ordinary reaction systems, because the solubility of the resin may greatly decrease when either chloride is not greater than 30 mol % of the total amount of chloride.

The polycarbonate resin having a structural unit represented by the general formula (2) can be prepared by polymerization of bisphenol represented by the following general formula (5) in the presence of phosgene:

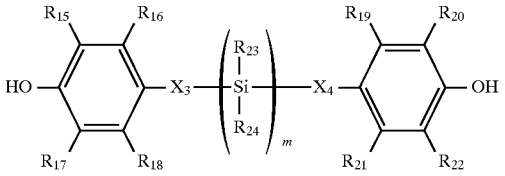

(5)

wherein $X_3$, $X_4$, $R_{15}$ to $R_{24}$, and m are the same as in the general formula (1).

Preferred examples of bisphenols represented by the general formulae (3) and (5) are as follows, but are not to limited to:

Compound 1

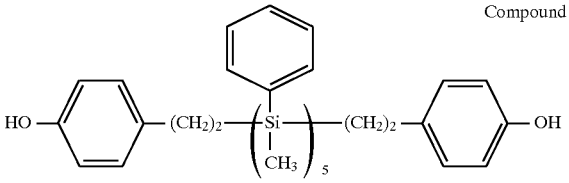

Compound 2

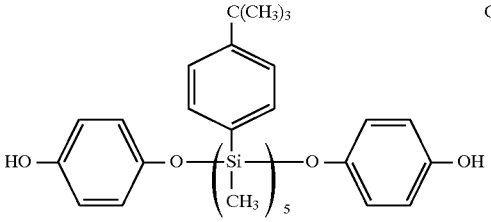

Compound 3

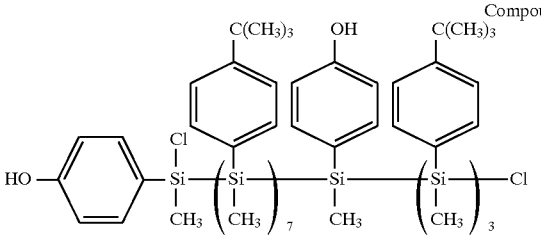

Conpound 4

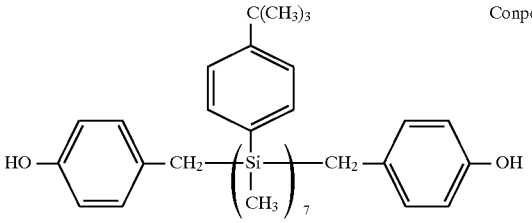

-continued

Compound 5

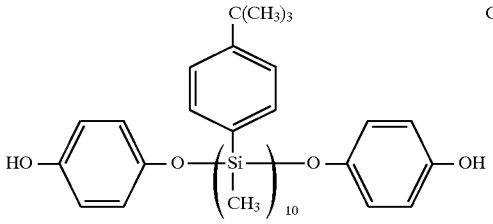

Compound 6

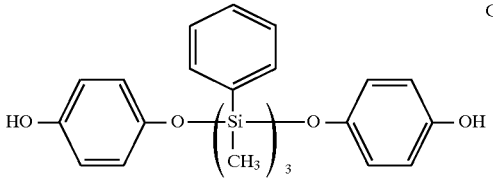

Compound 7

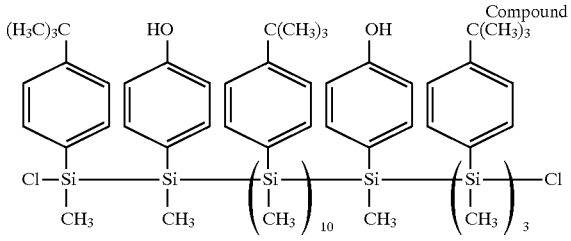

Compound 8

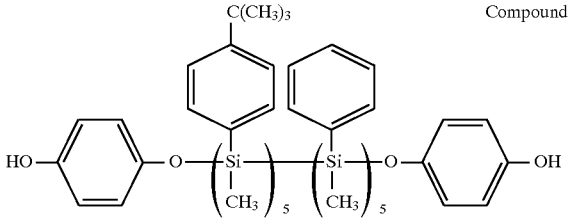

Compound 9

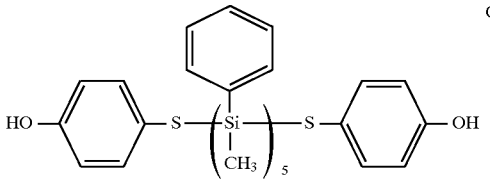

Compound 10

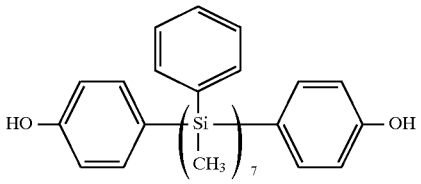

Compound 11

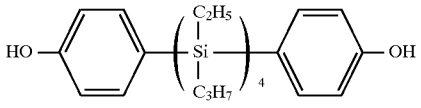

Compound 12

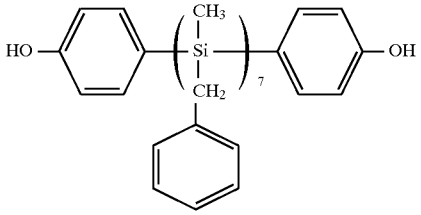

-continued
Compound 13
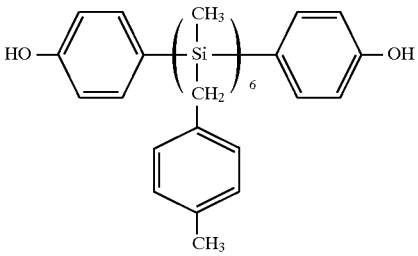
Compound 14
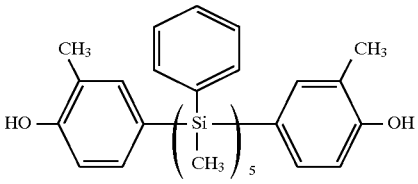
Compound 15
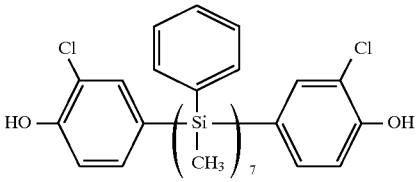
Compound 16
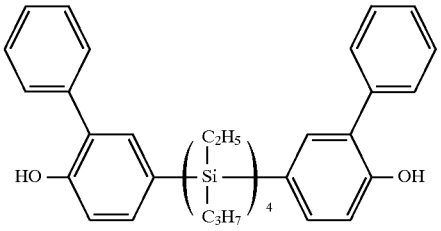
Compound 17
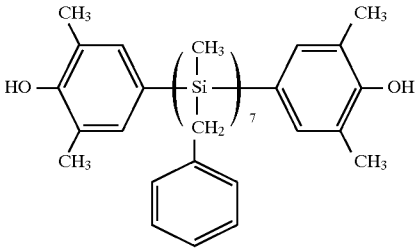
Compound 18
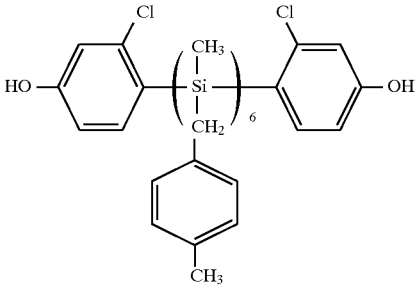
-continued
Compound 19
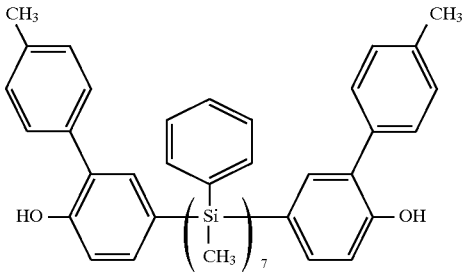
Compound 20
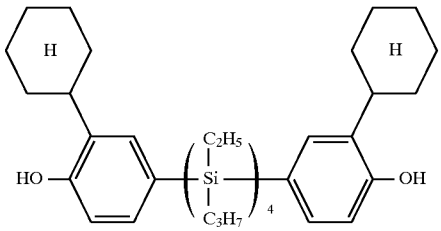
Compound 21
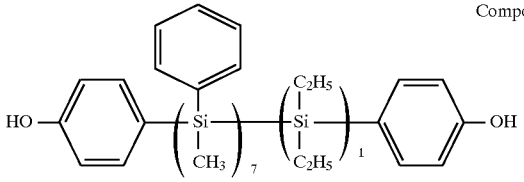
Among them, Compounds 1, 2, 3, 10 and 21 are more preferable and Compounds 1, 2, 10 and 21 are most preferable.
Examples of preferred aromatic dicarboxylic acids represented by the general formula (4) are as follows, but are not limited to:
Compound 22
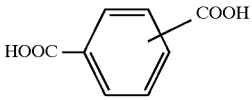
Compound 23
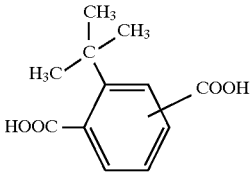
Compound 24
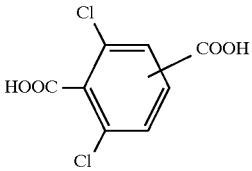

-continued

Compound 25

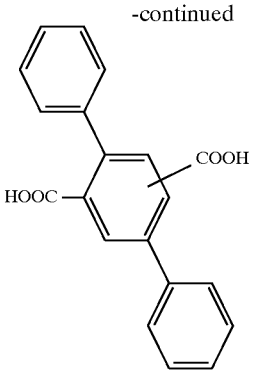

Compound 26

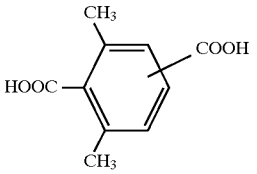

In the present invention, the above-mentioned bisphenols may be used alone or in combination.

It is preferable that the above-mentioned bisphenols be copolymerized with a bisphenol represented by the following general formula (6) in order to enhance flexibility of the resulting resin:

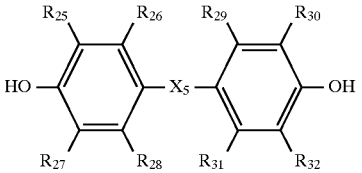

(6)

wherein $X_5$ is single bond, —O—, —S—, or substituted or unsubstituted alkylidene or substituted or unsubstituted cycloalkylidene, and $R_{25}$ to $R_{32}$ are each hydrogen, halogen, substituted or unsubstituted alkyl or substituted or unsubstituted aryl and are the same or different.

The halogen atoms represented in the general formula (6) include fluorine, chlorine and bromine. The alkyl groups are preferably methyl, ethyl and propyl. The alkylidenes are preferably ethylidene and isopropylidene. The cycloalkylidenes are preferably cyclopentylidene and cyclohexylidene. The aryl groups are preferably phenyl, naphthyl and anthryl. The substituents for the groups described above include halogen, alkyl and aryl.

Preferable examples of bisphenols represented by the general formula (6) include bisphenol Z ($X_5$ is cyclohexylidene and $R_{25}$ to $R_{32}$ are hydrogen) , bisphenol A ($X_5$ is isopropylidene and $R_{25}$ to $R_{32}$ are hydrogen), bisphenol C ($X_5$ is isopropylidene, $R_{25}$ to $R_{32}$ are methyl, and $R_{26}$ to $R_{31}$ are hydrogen) and bisphenol AF ($X_5$ is hexafluoroisopropylidene and $R_{25}$ to $R_{32}$ are hydrogen). Among them, bisphenol Z, bisphenol A and bisphenol C are more preferably used.

In the copolymerization, it is preferable that a bisphenol represented by the general formula (3) or (4) be 1 to 80 mol %, and more preferably 1 to 40 mol % of the total amount of bisphenol. However, such a ratio may change with the structure of the bisphenol employed.

In the present invention, two or more types of polyarylate resins having structural units represented by the general formula (1) and polycarbonate resins having structural units represented by the general formula (2) can be used as a blend. Further, resins having other structural units not represented by the general formulae (1) and (2) can be blended within a range achieving the advantages of the present invention.

The electrophotographic photosensitive member in accordance with the present invention exhibits particularly high solvent crack resistance, high mechanical strength, low photomemory characteristics and high electrical durability to AC charge.

The polyarylate resin and the polycarbonate resin used in the present invention contain stiffness segments in their structural units, and it is considered that durability of the polymer coating film of the electrophotographic photosensitive member is improved by partial vitrification of these segments during formation of the electrophotographic photosensitive member.

Further, no crack formation is presumed as follows. Such partial vitrification increases intramolecular density and results in the presence of both amorphous regions and crystal regions in the same molecule. Therefore, intramolecular stress formed during film coating can be relaxed, and the stress is maintained if immersed in chemicals that form solvent cracks. Also, high mechanical strength is probably due to crystal regions.

High electrical durability is presumed as silylene bonds, having no active proton, in the general formulae (1) and (2) are significantly stable to electrical stress and thus electrical chain scission will hardly occur.

Polymeric resins essentially consisting of silylene bonds also do not deteriorate in direct charge, but are mechanically considerably brittle due to high vitrification characteristics of the film.

Improvement in memory characteristics is probably due to the silylene structure in the present invention having some hole transfer characteristics.

Figure 2:
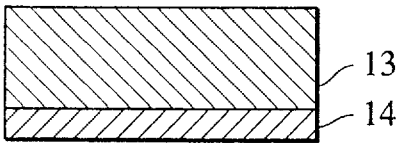
FIG. 2 is a cross-sectional view of a photosensitive layer having a single-layer structure in accordance with the present invention.
Figure 3:
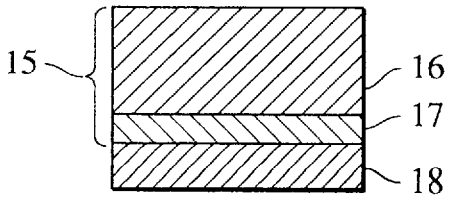
FIG. 3 is a cross-sectional view of a photosensitive layer having a laminated structure in accordance with the present invention.

When the photosensitive layer has a single-layer structure which contains both a charge generating material and a charge transfer material, the surface layer of the electrophotographic photosensitive member in accordance with the present invention represents the photosensitive layer itself. This embodiment is illustrated in FIG. 2, wherein a single photosensitive layer 13 is formed on substrate 14. When the photosensitive layer has a laminated structure consisting of a charge generating layer containing a charge generating material and a charge transfer layer containing a charge transfer material, the surface layer represents the charge transfer layer. This laminated structure embodiment is illustrated in FIG. 3 in which a photosensitive layer 15 contains an outer charge transfer layer 16 and a charge generating layer 17, which, in turn, is laminated to a substrate 18. In the present invention a laminated structure is preferable in view of electrophotographic characteristics.

The charge transfer layer can be formed by applying a solution, in which the resin set forth above as a binder, a charge transfer material are dissolved in an appropriate solvent, to a substrate, followed by drying. Examples of usable charge transfer materials include triarylamine compounds, hydrazone compounds, stilbene compound, pyrazoline compound, oxazole compounds, triallylmethane compounds and thiazole compounds. The ratio of the charge transfer material and the binder preferably ranges from 1:0.5 to 1:2 by weight. The thickness of the charge transfer layer preferably ranges from 5 $\mu$m to 40 $\mu$m, and more preferably 15 $\mu$m to 30 $\mu$m.

The charge generating layer can be formed by applying and drying a dispersion containing a charge generating material, a binder and a solvent, in which the amount of the binder resin is 0.3 to 4 times the charge generating material. The dispersion is prepared by dispersing the charge generating material and the binder in the solvent with a homogenizer, an ultrasonic dispersion machine, a ball mill, a vibrational ball mill, a sand mill, an attritor, a roll mill or a liquid collision type high speed dispersion machine. Examples of charge generating materials used in the present invention include dyes, such as selenium-tellurium dyes, pyrylium dyes and thiapyrylium dyes; and pigments, such as phthalocyanine pigments, anthanthrone pigments, dibenzopyrenequinone pigments, trisazo pigments, cyanine pigments, disazo pigments, monoazo pigments, indigo pigments, quinacridone pigments, and asymmetric quinocyanine pigments. The thickness of the charge transfer layer preferably is not more than 5 μm, and more preferably ranges from 0.1 to 2 μm.

When the photosensitive layer has a single-layer structure, the layer can be formed by coating and drying a solution or dispersion containing the charge generating material and charge transfer material, as well as the above-mentioned resin. The thickness preferably ranges from 5 to 40 μm and more preferably from 15 to 30 μm.

The surface layer in accordance with the present invention may contain an antioxidant and a lubricant.

Materials for use in the substrates in accordance with the present invention include conductive materials. Examples of such conductive materials include metals such as aluminum and stainless steel, metals, paper, and plastics provided with a conductive layer. These conductive materials may have a sheet or cylindrical shape.

In the present invention, a conductive layer may be provided between the substrate and the photosensitive layer in order to prevent interference band formation or to cover flaws on the substrate. Such a conductive layer can be formed by applying and drying a dispersion containing a conductive powder, such as carbon black or a particulate metal oxide, and a binding resin. The thickness of the conductive layer preferably ranges from 5 μm to 40 μm, and more preferably from 10 to 30 μm.

In the present invention, an interlayer having adhesiveness and barrier properties may be provided between the substrate and the photosensitive layer. Examples of the interlayer materials include polyamides, polyvinyl alcohol, polyethylene oxide, ethyl cellulose, casein, polyurethanes, and polyether urethanes. These materials may be applied as a solution in an appropriate solvent. The thickness of the interlayer preferably ranges from 0.05 μm to 5 μm, and more preferably 0.3 μm to 1 μm.

FIG. 1 is a schematic cross-sectional view of an electrophotographic apparatus provided with a process cartridge using an electrophotographic photosensitive member in accordance with the present invention.

In FIG. 1, an electrophotographic photosensitive member 1 in accordance with the present invention rotates along an axis 2 in the direction as shown by the arrow at a predetermined speed. The peripheral surface of the photosensitive member 1 is uniformly charged at a given negative or positive potential with a primary charging means 3 during rotation, and is then subjected to image exposure 4 by an exposure means (not shown in the drawing), such as a slit exposure, or a laser beam scanning exposure. A latent image is continuously formed on the peripheral surface of the photosensitive member 1.

The formed latent image is developed with a toner by a developing means 5 and the developed toner image is transferred to a recording material 7 by a transfer means 6. In the transfer means 6, the recording material is fed from a feeding section (not shown in the drawing) to a space between the photosensitive member 1 and the transfer means 6 in synchronism with the rotation of the photosensitive member 1. The toner image is transferred to recording material 7 from the surface of the photosensitive member 1. The recording material 7 is separated from the photosensitive member surface and conducted to an image fixing means 8. The transferred image on the recording material 7 is fixed by the image fixing means 8. The recording material 7 containing the fixed toner image is passed out of the apparatus as a copy.

The surface of the photosensitive member 1, after the image transfer, is cleaned with cleaning means 9 which removes the residual toner on the surface, is de-electrified by preliminary exposure light 10 from a preliminary exposing means (not shown in the drawing), and then is used for the next image formation. When the primary charging means 3 is a contact charging means using a charging roll or the like, the preliminary exposure light is not always necessary.

In the present invention, a plurality of the components selected from the group consisting of the photosensitive member 1, the primary charging means 3, the developing means 5 and the cleaning means 9 are integrated in a process cartridge, which can be loaded to and unloaded from the main body of an electrophotographic apparatus, e.g. a copying machine or a laser beam printer. For example, at least one component of the primary charging means 3, the developing means 5 and the cleaning means 9 is integrated with the photosensitive member 1 in process cartridge 11, and process cartridge 11 is loaded to and unloaded from the main body of the apparatus using a guiding means, e.g. rails 12 in the main body.

In FIG. 1, image exposure 4 represents reflected light or transmitted light from an original document, or light from a laser, LED or shutter array, driven by signals from the original document when the electrophotographic apparatus is a copying machine or a printer.

The present invention will now be illustrated in detail with reference to the following representative Examples which are not limitative of scope. In the Examples, "pbw" means "parts by weight".

EXAMPLES 1 THROUGH 20

On an aluminum cylinder of 30×254 mm, a paint based on the following formulation was applied by a dip coating process and cured at 140° C. for 30 minutes. A conductive layer having a thickness of 15 μm was formed.

| | |
|---|---|
| Conductive pigment: $SnO_2$ coated barium sulfate | 10 pbw |
| Pigment for adjusting resistance: titanium oxide | 2 pbw |
| Binder resin: phenol resin | 6 pbw |
| Leveling material: silicone oil | 0.001 pbw |
| Solvent: methanol/methoxypropanol (0.2/0.8) | 20 pbw |

A solution composed of 3 pbw of N-methoxymethylated nylon, 3 pbw of copolymeric nylon and a solvent mixture of 65 pbw of methanol and 30 pbw of n-butanol was coated on the resulting conductive layer by a dip coating process, followed by drying. An interlayer having a thickness of 0.5 μm was formed.

A dispersion was prepared by dispersing 4 pbw of oxytitanium phthalocyanine having strong X-ray (CuKαcharacteristic) diffraction peaks (2θ±0.2 degrees) at 9.0 degrees, 14.2 degrees, 23.9 degrees and 27.1 degrees and 2 pbw of polyvinyl butyral (Trade Name: S-LEC, made by Sekisui Chemical Co., Ltd.) into 60 pbw of cyclohexanone using a sand mill with 1-mm glass beads for 4 hours; and then adding 100 pbw of ethyl acetate. The dispersion was coated on the interlayer by a dip coating process, followed by drying. A charge generating layer having a thickness of 0.3 μm was formed.

Next, in each Example, 9 pbw of a triarylamine compound represented by the following chemical formula (A), 1 pbw of a styryl compound represented by the following chemical formula (B) and 10 pbw of a resin listed in Table 1 were dissolved into a solvent mixture of 30 pbw of monochlorobenzene and 70 pbw of dichloromethane.

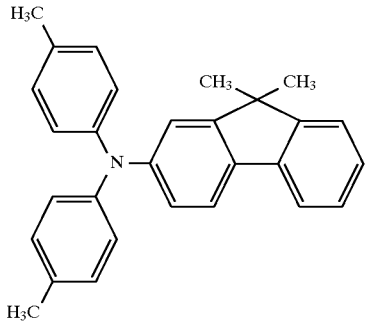

(A)

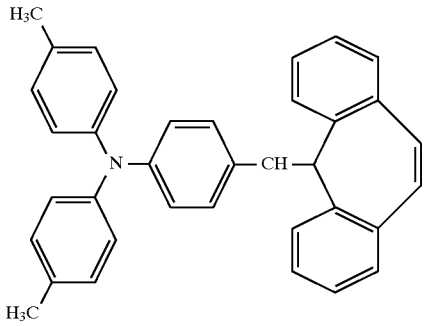

(B)

The resin was synthesized as follows: Bisphenol (0.002 mol) represented in Compound 1, bisphenol C (0.002 mol) and bisphenol Z (0.002 mol) were placed into a 1-liter mixer containing an aqueous solution in which sodium hydroxide (0.8 g) and tetramethylammonium chloride (1 g) were dissolved into 100 ml water. A solution formed of terephthalyl chloride (0.003 mol) and isophthalyl chloride (0.003 mol) dissolved in 1,2-dichloroethane (30 ml), was added to the mixer while stirring. The mixture was further stirred at high speed for 10 minutes after the addition, and allowed to stand for 2 hours, thereby forming a 1,2-dichloroethane layer. Then, the 1,2-dichloroethane layer was recovered and a large amount of hexane was added to the 1,2-dichloroethane solution to precipitate the resulting resin. After washing with water and then methanol, the resin was purified by dissolving into chloroform and then precipitating again with methanol. The final yield was 65%. The molecular weight was determined by gel permeation chromatography.

The solution containing the charge transfer material and the resin was coated on the charge generating layer by a dip coating process and dried at 120° C. for 2 hours. A charge transfer layer having a thickness of 25 μm was formed.

Each resulting electrophotographic photosensitive member was evaluated as follows:

The electrophotographic photosensitive member was loaded in a modified LBP "Laser Writer 16/600PS" made by Apple (process speed: 98 mm/sec). The modification involves constant voltage control of primary charging instead of a constant current control. The electrophotographic photosensitive member was subjected to continuous paper feeding test with the modified apparatus at 28° C. and 90% RH. An image used in the test was an A4 size grid pattern with a printing rate of 4%. The operation was performed by an intermittent mode stop per print. The copying operation was continued until fogging occurred by visual observation, while supplying toner. The number of repeated copying cycles was recorded as durability. Taber abrasion of a fresh electrophotographic photosensitive member was determined by means of weight loss during an abrasion test for 25 minutes using an ABRASION TESTER made by Yasuda Seiki Seisakusho Co., Ltd. with an abrasion tape. A photomemory value was determined as follows: A section of a fresh electrophotographic photosensitive member was irradiated with light from a white fluorescent lighting of 3000 Lux for 20 minutes, allowed to stand for 15 minutes, and then subjected to light portion potential measurement. The photomemory value was defined as a difference in light portion potential between the light irradiated section and the non-light-irradiated section. The light portion potential was determined by measuring a surface potential when a solid black image was formed on the electrophotographic photosensitive member in the same LBP with a surface potentiometer.

Solvent crack resistance was determined as follows: Finger grease was adhered to the surface of a fresh electrophotographic photosensitive member, allowed to stand for 48 hours, then solvent crack formation was observed by microscopy. These results are set forth in Table 1.

TABLE 1

| | Composition of bisphenol | | | | | |
|---|---|---|---|---|---|---|
| Example | General Formula (3) | Mol fraction of the bisphenol in the polymer | General Formula (6) | Mol fraction of the bisphenol in the polymer | General Formula (6) | Mol fraction of the bisphenol in the polymer |
| 1 | Compound 1 | 33.3 | Bisphenol C | 33.3 | Bisphenol Z | 33.3 |
| 2 | Compound 1 | 25 | Bisphenol C | 75 | — | — |
| 3 | Compound 1 | 65 | Bisphenol C | 20 | Bisphenol Z | 15 |
| 4 | Compound 1 | 50 | Bisphenol C | 25 | Bisphenol A | 25 |
| 5 | Compound 2 | 33.3 | Bisphenol C | 33.3 | Bisphenol Z | 33.3 |
| 6 | Compound 2 | 25 | Bisphenol C | 75 | — | — |
| 7 | Compound 2 | 65 | Bisphenol C | 20 | Bisphenol Z | 15 |
| 8 | Compound 3 | 33.3 | Bisphenol C | 33.3 | Bisphenol Z | 33.3 |
| 9 | Compound 4 | 33.3 | Bisphenol C | 33.3 | Bisphenol Z | 33.3 |
| 10 | Compound 5 | 33.3 | Bisphenol C | 33.3 | Bisphenol Z | 33.3 |
| 11 | Compound 10 | 10 | Bisphenol C | 90 | — | — |
| 12 | Compound 10 | 15 | Bisphenol C | 85 | — | — |

TABLE 1-continued

| | | | | | | |
|---|---|---|---|---|---|---|
| 13 | Compound 10 | 20 | Bisphenol C | 80 | — | — |
| 14 | Compound 10 | 20 | Bisphenol C | 40 | Bisphenol A | 40 |
| 15 | Compound 10 | 10 | Bisphenol C | 80 | Bisphenol A | 10 |
| 16 | Compound 12 | 100 | — | — | — | — |
| 17 | Compound 13 | 50 | Bisphenol C | 50 | — | — |
| 18 | Compound 11 | 50 | Bisphenol C | 50 | — | — |
| 19 | Compound 11 | 33.3 | Bisphenol C | 33.3 | Bisphenol A | 33.3 |
| 20 | Compound 21 | 10 | Bisphenol C | 90 | — | — |

| Example | Weight average molecular weight | Durability (× 10,000) | Taber abrasion (mg) | Photo-memory (V) | Solvent crack resistance |
|---|---|---|---|---|---|
| 1 | 73,000 | 2.6 | 1.3 | 5 | No cracks |
| 2 | 74,000 | 2.9 | 1.3 | 5 | No cracks |
| 3 | 78,000 | 2.9 | 1.3 | 10 | No cracks |
| 4 | 69,000 | 2.2 | 1.3 | 5 | No cracks |
| 5 | 72,000 | 2.5 | 1.2 | 5 | No cracks |
| 6 | 73,000 | 2.8 | 1.1 | 5 | No cracks |
| 7 | 71,000 | 2.6 | 1.3 | 5 | No cracks |
| 8 | 58,000 | 2.9 | 1.3 | 10 | No cracks |
| 9 | 71,000 | 2.7 | 1.5 | 5 | No cracks |
| 10 | 67,000 | 2.8 | 1.2 | 5 | No cracks |
| 11 | 82,000 | 3.1 | 1.1 | 10 | No cracks |
| 12 | 79,000 | 2.8 | 1.2 | 15 | No cracks |
| 13 | 79,000 | 2.8 | 1.1 | 10 | No cracks |
| 14 | 83,000 | 2.5 | 1.2 | 10 | No cracks |
| 15 | 73,000 | 2.7 | 1.3 | 15 | No cracks |
| 16 | 71,000 | 2.0 | 1.6 | 5 | No cracks |
| 17 | 68,000 | 2.7 | 1.1 | 5 | No cracks |
| 18 | 69,000 | 2.8 | 1.2 | 5 | No cracks |
| 19 | 73,000 | 2.8 | 1.1 | 15 | No cracks |
| 20 | 71,000 | 2.7 | 1.1 | 15 | No cracks |

EXAMPLES 21 THROUGH 40

A series of electrophotographic photosensitive members were prepared and evaluated as in Example 1, except that resins represented in Table 2 were used in charge transfer layers.

Each resin was synthesized as follows: Bisphenol (0.033 mol) represented in Compound 1, bisphenol C (0.033 mol) and bisphenol Z (0.033 mol) were placed into a four neck flask, and 228 ml of pyridine was added. While stirring a gas inlet and a gas outlet were connected to the flask, and phosgene was fed into the flask through the gas inlet for 30 minutes at a rate of 0.25 g/min in a draft chamber. After gas introduction, the solution was further stirred for 20 minutes, and 250 ml of methanol was added over 5 minutes to precipitate the resulting resin. After collecting the precipitated resin, the resin was washed with 500 ml of methanol, and dried. Then, the resin was dissolved in 50 ml of chloroform and the solution was dropped into 1 liter of methanol, followed by filtration and drying. The final yield was 68%. The results are shown in Table 2.

TABLE 2

| | Composition of bisphenol | | | | | |
|---|---|---|---|---|---|---|
| Example | General Formula (5) | Mol fraction of the bisphenol in the polymer | General Formula (6) | Mol fraction of the bisphenol in the polymer | General Formula (6) | Mol fraction of the bisphenol in the polymer |
| 21 | Compound 1 | 33.3 | Bisphenol C | 33.3 | Bisphenol Z | 33.3 |
| 22 | Compound 1 | 25 | Bisphenol C | 75 | — | — |
| 23 | Compound 1 | 65 | Bisphenol C | 20 | Bisphenol Z | 15 |
| 24 | Compound 1 | 50 | Bisphenol C | 25 | Bisphenol A | 25 |
| 25 | Compound 2 | 33.3 | Bisphenol C | 33.3 | Bisphenol Z | 33.3 |
| 26 | Compound 2 | 25 | Bisphenol C | 75 | — | — |
| 27 | Compound 2 | 65 | Bisphenol C | 20 | Bisphenol Z | 15 |
| 28 | Compound 3 | 33.3 | Bisphenol C | 33.3 | Bisphenol Z | 33.3 |
| 29 | Compound 4 | 33.3 | Bisphenol C | 33.3 | Bisphenol Z | 33.3 |
| 30 | Compound 5 | 33.3 | Bisphenol C | 33.3 | Bisphenol Z | 33.3 |
| 31 | Compound 10 | 10 | Bisphenol C | 90 | — | — |
| 32 | Compound 10 | 15 | Bisphenol C | 85 | — | — |
| 33 | Compound 10 | 20 | Bisphenol C | 80 | — | — |
| 34 | Compound 10 | 20 | Bisphenol C | 40 | Bisphenol Z | 40 |
| 35 | Compound 10 | 10 | Bisphenol Z | 90 | — | — |
| 36 | Compound 12 | 100 | — | — | — | — |
| 37 | Compound 13 | 50 | Bisphenol C | 50 | — | — |
| 38 | Compound 11 | 50 | Bisphenol C | 50 | — | — |

TABLE 2-continued

| | | | | | | |
|---|---|---|---|---|---|---|
| 39 | Compound 11 | 33.3 | Bisphenol C | 33.3 | Bisphenol Z | 33.3 |
| 40 | Compound 21 | 10 | Bisphenol C | 90 | — | — |

| Example | Weight average molecular weight | Durability (× 10,000) | Taber abrasion (mg) | Photo-memory (V) | Solvent crack resistance |
|---|---|---|---|---|---|
| 21 | 65,000 | 2.4 | 1.4 | 10 | No cracks |
| 22 | 66,000 | 2.5 | 1.4 | 10 | No cracks |
| 23 | 69,000 | 2.5 | 1.5 | 5 | No cracks |
| 24 | 72,000 | 2.6 | 1.5 | 10 | No cracks |
| 25 | 71,000 | 2.5 | 1.5 | 10 | No cracks |
| 26 | 70,000 | 2.4 | 1.5 | 5 | No cracks |
| 27 | 69,000 | 2.5 | 1.6 | 5 | No cracks |
| 28 | 66,000 | 2.7 | 1.5 | 10 | No cracks |
| 29 | 68,000 | 2.6 | 1.5 | 5 | No cracks |
| 30 | 68,000 | 2.3 | 1.4 | 5 | No cracks |
| 31 | 83,000 | 2.5 | 1.4 | 5 | No cracks |
| 32 | 65,000 | 2.7 | 1.4 | 5 | No cracks |
| 33 | 69,000 | 2.6 | 1.3 | 10 | No cracks |
| 34 | 73,000 | 2.8 | 1.4 | 5 | No cracks |
| 35 | 75,000 | 2.6 | 1.4 | 5 | No cracks |
| 36 | 63,000 | 1.9 | 2.0 | 10 | No cracks |
| 37 | 66,000 | 2.5 | 1.8 | 10 | No cracks |
| 38 | 62,000 | 2.4 | 1.5 | 5 | No cracks |
| 39 | 68,000 | 2.6 | 1.6 | 5 | No cracks |
| 40 | 65,000 | 2.7 | 1.1 | 15 | No cracks |

COMPARATIVE EXAMPLES 1 THROUGH 5

Electrophotographic photosensitive members were prepared and evaluated as in Example 1, except that the compounds described in Table 3 were used as resins for charge transfer layers. The Structural Units 1 through 5 in Table 3 have the following structures:

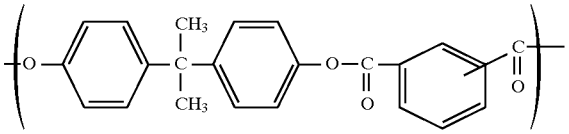

Structral Unit 2:

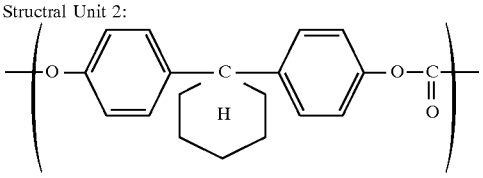

Structural Unit 3:

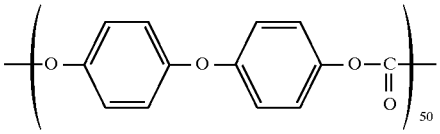

-continued

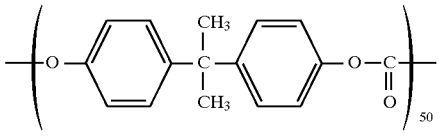

Structural Unit 4:

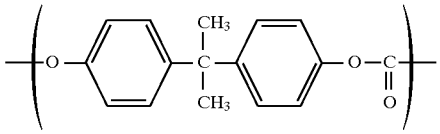

Structural Unit 5:

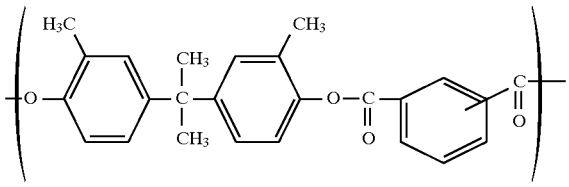

Results are shown in Table 3.

TABLE 3

| Comparative Example | Structural unit of resin | Weight average molecular weight | Durability (× 10,000) | Taber abrasion (mg) | Photo-memory (V) | Solvent crack resistance |
|---|---|---|---|---|---|---|
| 1 | Structural Unit 1 | 32,000 | 2.1 | 1.3 | 75 | No cracks |
| 2 | Structural Unit 2 | 48,000 | 0.9 | 3.0 | 100 | Cracks found |
| 3 | Structural Unit 3 | 45,000 | 0.3 | 4.1 | 115 | No cracks |
| 4 | Structural Unit 4 | 50,000 | 0.1 | 3.5 | 95 | Cracks found |
| 5 | Structural Unit 5 | 69,000 | 2.5 | 1.0 | 70 | No cracks |

While the present invention has been described with reference to what are presently considered to be the preferred embodiments, it is to be understood that the invention is not limited to the disclosed embodiments. To the contrary, the invention is intended to cover various modifications and equivalent arrangements, included within the spirit and scope of the appended claims. The scope of the following claims is to be accorded the broadest interpretation so as to encompass all such modifications and equivalent structures and functions.

What is claimed is:

1. An electrophotographic photosensitive member comprising: a substrate and a photosensitive layer formed thereon, a surface layer of the photosensitive layer containing at least one resin selected from the group consisting of (a) a polyarylate resin having a structural unit represented by the following general formula (1) and (b) a polycarbonate resin having a structural unit represented by the following general formula (2):

(1)

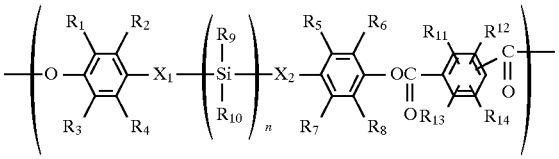

wherein, $X_1$ and $X_2$ are each single bond, —O—, —S— or substituted or unsubstituted alkylene and are the same or different, $R_1$ to $R_8$ and $R_{11}$ to $R_{14}$ are each hydrogen, halogen, or substituted or unsubstituted alkyl or substituted or unsubstituted aryl and are the same or different, and $R_9$ and $R_{10}$ are each hydrogen, halogen, or substituted or unsubstituted silyl, substituted or unsubstituted alkyl or substituted or unsubstituted aryl and are the same or different, and n is an integer of 2 or more;

(2)

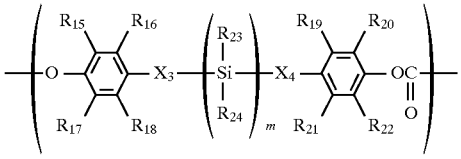

wherein $X_3$ and $X_4$ are each single bond, —O—, —S— or substituted or unsubstituted alkylene and are the same or different, $R_{15}$ to $R_{22}$ are each hydrogen, halogen, substituted or unsubstituted alkyl or substituted or unsubstituted aryl and are the same or different, $R_{23}$ and $R_{24}$ are each hydrogen, halogen, substituted or unsubstituted silyl, substituted or unsubstituted alkyl or substituted or unsubstituted aryl and are the same or different, and m is an integer of 2 or more.

2. An electrophotographic photosensitive member according to claim 1, wherein said at least one resin is a polyarylate resin.

3. An electrophotographic photosensitive member according to claim 1, wherein $X_1$ and $X_2$ are each single bond, —O— or unsubstituted ethylene, $R_1$ to $R_8$ are each hydrogen, $R_9$ is phenyl, $R_{10}$ is methyl, and n is 5 or 7.

4. An electrophotographic photosensitive member according to claim 2, wherein said polyarylate resin further comprises the following structural unit:

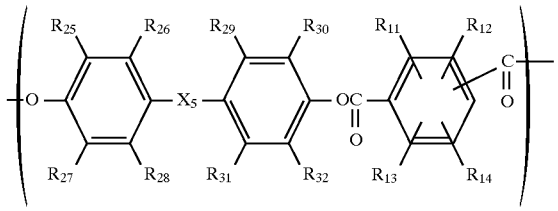

wherein $X_5$ is single bond, —O—, —S—, or substituted or unsubstituted alkylidene or substituted or unsubstituted cycloalkylidene, and $R_{11}$ to $R_{14}$ and $R_{25}$ to $R_{32}$ are each hydrogen, halogen, or substituted or unsubstituted alkyl or substituted or unsubstituted aryl.

5. An electrophotographic photosensitive member according to claim 4, wherein, said structural unit comprises a combination selected from the group consisting of (i) $X_5$ being isopropylidene and each of $R_{25}$ to $R_{32}$ being hydrogen; (ii) $X_5$ being cyclohexylidene and each of $R_{25}$ to $R_{32}$ being hydrogen; and (iii) $X_5$ being isopropylidene, each of $R_{25}$ and $R_{32}$ being methyl and each of $R_{26}$ to $R_{31}$ being hydrogen.

6. An electrophotographic photosensitive member according to claim 2, wherein said polyarylate resin is synthesized from (i) a bisphenol represented by the following general formula (3) and (ii) an aromatic dicarboxylic acid:

(3)

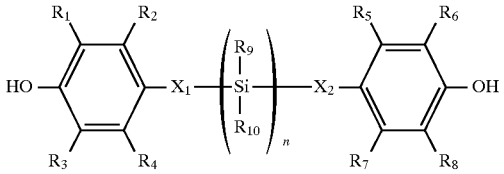

wherein $X_1$, $X_2$, $R_1$ to $R_{10}$ and n are the same as in the general formula (1).

7. An electrophotographic photosensitive member according to claim 6, wherein said aromatic dicarboxylic acid is represented by the following general formula (4):

(4)

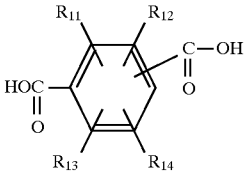

wherein $R_{11}$ to $R_{14}$ are the same as in the general formula (1).

8. An electrophotographic photosensitive member according to claim 1, wherein said at least one resin is a polycarbonate resin.

9. An electrophotographic photosensitive member according to claim 8, wherein $X_3$ and $X_4$ are each single bond, —O— or unsubstituted ethylene, $R_{15}$ to $R_{22}$ ar each hydrogen, $R_{23}$ is phenyl, $R_{24}$ is methyl, and m is 5 or 7.

10. An electrophotographic photosensitive member according to claim 8, wherein said polycarbonate resin further comprises the following structural unit:

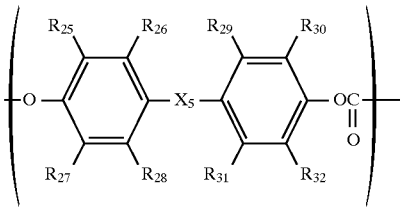

wherein $X_5$ is single bond, —O—, —S—, or substituted or unsubstituted alkylidene or substituted or unsubstituted cycloalkylidene, and $R_{25}$ to $R_{32}$ are each hydrogen, halogen, or substituted or unsubstituted alkyl or substituted or unsubstituted aryl.

11. An electrophotographic photosensitive member according to claim 10, wherein said structural unit comprises a combination selected from the group consisting of (i) $X_5$ being isopropylidene and each of $R_{25}$ to $R_{32}$ being hydrogen; (ii) $X_5$ being cyclohexylidene and each of $R_{25}$ to $R_{32}$ being hydrogen; and (iii) $X_5$ being isopropylidene, each of $R_{25}$ and $R_{32}$ being methyl and each of $R_{26}$ to $R_{31}$ being hydrogen.

12. An electrophotographic photosensitive member according to claim 8, wherein said polycarbonate resin is synthesized from (i) a bisphenol represented by the following general formula (5) and (ii) phosgene:

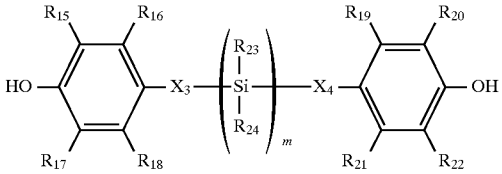

(5)

wherein $X_3$, $X_4$, $R_{15}$ to $R_{24}$, and m are the same as in the general formula (2).

13. An electrophotographic photosensitive member according to claim 1, wherein said photosensitive layer is a laminate in this order of a charge generating layer and a charge transfer layer on the substrate and the resin is present in the charge transfer layer as the surface layer.

14. A process cartridge, comprising: an electrophotographic photosensitive member and at least one means selected from the group consisting of a charging means, a developing means and a cleaning means, said electrophotographic photosensitive member and said at least one means being integrally supported and detachable from an electrophotographic apparatus main body, said electrophotographic photosensitive member comprising: a substrate and a photosensitive layer formed thereon, a surface layer of the photosensitive layer containing at least one resin selected from the group consisting of (a) a polyarylate resin having a structural unit represented by the following general formula (1) and (b) a polycarbonate resin having a structural unit represented by the following general formula (2):

(1)

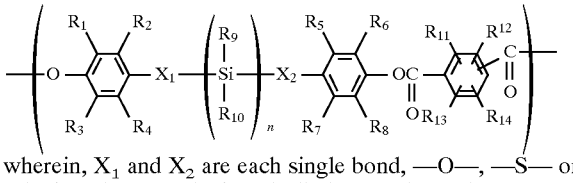

wherein, $X_1$ and $X_2$ are each single bond, —O—, —S— or substituted or unsubstituted alkylene and are the same or different, $R_1$ to $R_8$ and $R_{11}$ to $R_{14}$ are each hydrogen, halogen, or substituted or unsubstituted alkyl or substituted or unsubstituted aryl and are the same or different, and $R_9$ and $R_{10}$ are each hydrogen, halogen, or substituted or unsubstituted silyl, substituted or unsubstituted alkyl or substituted or unsubstituted aryl and are the same or different, and n is an integer of 2 or more;

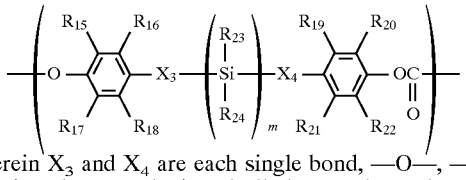

(2)

wherein $X_3$ and $X_4$ are each single bond, —O—, —S— or substituted or unsubstituted alkylene and are the same or different, $R_{15}$ to $R_{22}$ are each hydrogen, halogen, substituted or unsubstituted alkyl or substituted or unsubstituted aryl and are the same or different, $R_{23}$ and $R_{24}$ are each hydrogen, halogen, substituted or unsubstituted silyl, substituted or unsubstituted alkyl or substituted or unsubstituted aryl and are the same or different, and m is an integer of 2 or more.

15. A process cartridge according to claim 14, wherein said at least one resin is polyarylate resin.

16. A process cartridge according to claim 14, wherein said at least one resin is polycarbonate resin.

17. A process cartridge according to claim 14, wherein said charging means is a contact charging means.

18. An electrophotographic apparatus, comprising: an electrophotographic photosensitive member, a charging means, an exposure means, a developing means and a cleaning means, said electrophotographic photosensitive member comprising a substrate and a photosensitive layer formed thereon, a surface layer of the photosensitive layer containing at least one resin selected from the group consisting of (a) a polyarylate resin having a structural unit represented by the following general formula (1) and (b) a polycarbonate resin having a structural unit represented by the following general formula (2):

(1)

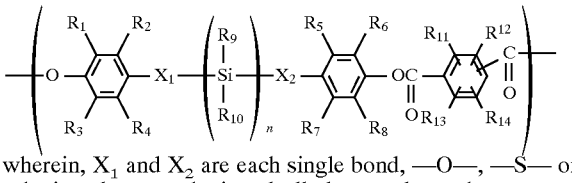

wherein, $X_1$ and $X_2$ are each single bond, —O—, —S— or substituted or unsubstituted alkylene and are the same or different, $R_1$ to $R_8$ and $R_{11}$ to $R_{14}$ are each hydrogen, halogen, or substituted or unsubstituted alkyl or substituted or unsubstituted aryl and are the same or different, and $R_9$ and $R_{10}$ are each hydrogen, halogen, or substituted or unsubstituted silyl, substituted or unsubstituted alkyl or substituted or unsubstituted aryl and are the same or different, and n is an integer of 2 or more;

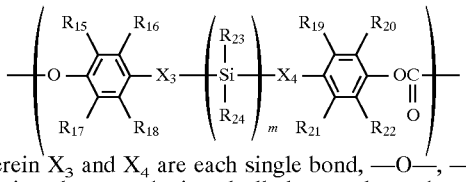

(2)

wherein $X_3$ and $X_4$ are each single bond, —O—, —S— or substituted or unsubstituted alkylene and are the same or different, $R_{15}$ to $R_{22}$ are each hydrogen, halogen, substituted or unsubstituted alkyl or substituted or unsubstituted aryl and are the same or different, $R_{23}$ and $R_{24}$ are each hydrogen, halogen, substituted or unsubstituted silyl, substituted or unsubstituted alkyl or substituted or unsubstituted aryl and are the same or different, and m is an integer of 2 or more.

19. An electrophotographic apparatus according to claim 18, wherein said at least one resin is polyarylate resin.

20. An electrophotographic apparatus according to claim 18, wherein said at least one resin is polycarbonate resin.

21. An electrophotographic apparatus according to claim 18, wherein said charging means is a contact charging means.

* * * * *